United States Patent [19]

Zaborowski

[11] Patent Number: 4,917,078

[45] Date of Patent: Apr. 17, 1990

[54] HAIR RADIATING JAW MEMBERS FOR HAIR CRIMPER

[75] Inventor: Thaddeus Zaborowski, Cambridge, Mass.

[73] Assignee: The Schawbel Corp., Cambridge, Mass.

[21] Appl. No.: 310,055

[22] Filed: Feb. 10, 1989

[51] Int. Cl.[4] ..... A45D 1/04

[52] U.S. Cl. ..... 126/409; 219/225

[58] Field of Search ..... 126/408, 409; 219/222, 219/225, 226; D28/38

[56] References Cited

U.S. PATENT DOCUMENTS

| | | | |
|---|---|---|---|
| 1,591,207 | 7/1926 | Berthelsen | 219/225 |
| 3,918,465 | 11/1975 | Barradas | 219/225 |
| 4,456,815 | 6/1984 | Andis | 219/225 |
| 4,699,123 | 10/1987 | Zaborowski | 126/409 |
| 4,740,669 | 4/1988 | Takimae | 219/225 |

*Primary Examiner*—Carroll B. Dority

*Attorney, Agent, or Firm*—Levisohn, Lerner & Berger

[57] ABSTRACT

A hairstyling device, preferably a hair crimper, is provided with a stationary jaw member having an aluminum plate which heats up either by a self-contained fuel burner or by electrical power and, in cooperation with a movable jaw member, styles hair to conform to a predetermined desired shape. The outside surfaces of the movable and stationary jaw members are provided with a set of spaced upwardly extending ribs, which serve both to allow finger contacting and manipulation of the jaw members of the device and, in addition, allow for efficient heat radiation so that the outside surface of the jaw members does not get uncomfortably hot.

4 Claims, 2 Drawing Sheets

32
28
26
24
34
32
16
14

34
14
32

HAIR RADIATING JAW MEMBERS FOR HAIR CRIMPER

BACKGROUND OF THE INVENTION

The present invention relates to a hairstyling device. In the preferred embodiment, the present invention is a portable hair crimper or curler which heats a pair of opposed jaw members and holds, between the opposed jaw members,.a tress or lock of hair to force the hair to conform to a predetermined desired shape. The opposed jaw members are provided with aluminum plates which heat up during use. It is well known that hair, when heated, will conform to the shape of the surface upon which the hair is held during the heating process. The present invention is an improvement on these hair crimpers and curlers, whether portable or electrically powered.

The present invention relates to a hairstyling heated device which is capable of imparting a predetermined shape to hair, as desired. More specifically, the preferred embodiment of the invention relates to a curling iron or hair crimper which is provided with a heatable plate-like surface which, when a hair tress is placed over the surface and held there by an opposed jaw member, the hair will be imparted with a predetermined shape. Hair curlers and hair crimpers are now extremely popular for providing new and interesting hair styles. Typically, the hair curlers and crimpers are electrically powered, i.e., the heat required for imparting the shape to the hair is provided by resistance elements which are electrically connected to a source of electrical power through an electric plug and cord. In addition, the technology is now available for these hair curlers and hair crimpers to be fully portable and the heat required for hair curling and crimping is provided by self-contained butane cartridges which are in fluid communication with fuel burners. The technology is similar to butane cigarette lighters and, when the flow of fuel is initiated and a spark provided, the flame from the fuel burner causes the plate-like surface of the hair curler or crimper to become heated to a sufficient temperature such that a hair tress, when placed on the plate-like surface and held there for a sufficient period of time, will conform to the shape of the plate.

The present invention, in particular, relates to a new means for allowing the heat radiated by the hair curling or crimping device to escape from the device such that the outside temperature of the device does not become uncomfortably hot if accidentally touched by a child, subsequent to use, the heat radiation provides for better temperature control and, in addition, the heat radiating mechanism also provides convenient hand or finger contact surfaces which facilitate the manual manipulation of the device for imparting the hairstyling by the individual to her own hair tresses.

DESCRIPTION OF THE PRIOR ART

Electrically powered hair curlers have been in use for quite some time. These devices generally comprise a forwardly extending cylinder or rod-like member which is internally wound with a resistance heating element which is connected by a conventional electric plug and cord to a source of household electric power. The rod is further provided with a sheet or cylindrical portion of metal which is pivotally connected to the rod. This sheet, when opened away from the rod, allows for the hair tress to be inserted between the rod and the sheet and, when closed, the sheet serves to hold the tress directly against the heated rod such that the tress is imparted with the desired crimped or curled shape. It is well known that heating hair to a sufficient temperature and holding the hair against a predetermined shape will impart to the hair that shape for a sufficient period of time so that a new hairstyle is provided. Today, this hairstyling, performed by hair curling and hair crimping in a plurality of different shapes and configurations, is extremely popular.

With the conventional electrically-powered hair curlers having the heatable rod and the gripping sheet or finger pivotally connected to the heatable rod, a forwardly projected conical member is often provided to allow hand manipulation of the end of the device so that curls can be more easily done on one's own hair. Typically, these hand manipulation or finger contact surfaces are made from some heat insulator-type material so that the individual will not become burned when touching the conical surface during curling.

Also, currently on the market with respect to hair styling devices are hair curlers or hair crimpers which are not electrically powered, rather, they are provided by heat generating butane fuel held within replaceable cartridges contained within the handle portion of the hairstyling devices. These, for example, are now available from the Conair Corporation of New Jersey, which are manufactured (under license) by The Schawbel Corporation of Cambridge, Mass. These butane-powered hair curlers and crimpers generally include a stationary jaw member having a heatable metal plate. The metal plate is heated by burning the butane fuel by a fuel burner system, the temperature of which is controlled by the internal mechanism of the device. That, however, does not form a part of the present invention. Hingedly connected to the hair curler or crimper, in a similar manner to the conical gripping finger of the electrically-powered hair curlers, is a movable jaw member. In the preferred embodiment of the prior art butane-powered hair curlers and crimpers, the movable jaw member is provided with a thin metal plate which conforms to the surface configuration of the heatable metal plate of the stationary jaw member. With a lock or tress of hair held between the metal plate and the metal sheet, and when the metal plate is heated to the predetermined desired temperature, the lock or tress of hair will be imparted with the desired shape or configuration of the metal plate.

This device, however, might get uncomfortably hot to the touch on its outside surface and, in addition, there is currently no provision for allowing hand or finger manipulation of the heated portion of the device to facilitate hairstyling of one's own hair.

The present invention, therefore, addresses the need to provide means for allowing heat to radiate from the device so that the temperature does not unnecessarily build up both internally and on the external surface of the jaw members and, in addition, provides a finger contact surface to the jaw members such that an individual can easily manipulate the device to perform the heat curling or crimping operation on his or her own hair.

SUMMARY OF THE INVENTION

The present invention relates to a heat radiating mechanism which is selectively attached to at least one of either the stationary jaw member or the movable jaw member of a hair curling or crimping device. Preferably, the heat radiating mechanism is a set of spaced-apart raised ribs of the stationary or movable hair styling jaw members. According to the preferred embodiment of the present invention, the raised ribs are located on both the stationary and the movable jaw members and, indeed, wrap around to the front of the jaw members to provide additional cooling and heat radiation surfaces. Furthermore, the heat radiating mechanism of the present invention provides extremely convenient finger contact surfaces to allow for ease of handling of the device and, in particular, allows the device to be used on one's own hair with a minimum of effort and certainly without causing discomfort to the user by accidentally touching a heated surface which is uncomfortably hot. The heat radiating mechanism thus provides raised ribs which not only allow the heat of the device to smoothly dissipate so that the outside of the device does not become uncomfortably hot and the inside inefficiently heated, but, in addition, provides a convenient spot for placing one's fingers or hands during use of the device. This is especially useful when the device is used on one's own hair for imparting the desired shape or configuration thereto and especially since it is often difficult to see the heatable head or jaw members of the device when the device is used on one's own hair.

DETAILED DESCRIPTION OF THE DRAWINGS AND THE PREFERRED EMBODIMENT

Figure 1:
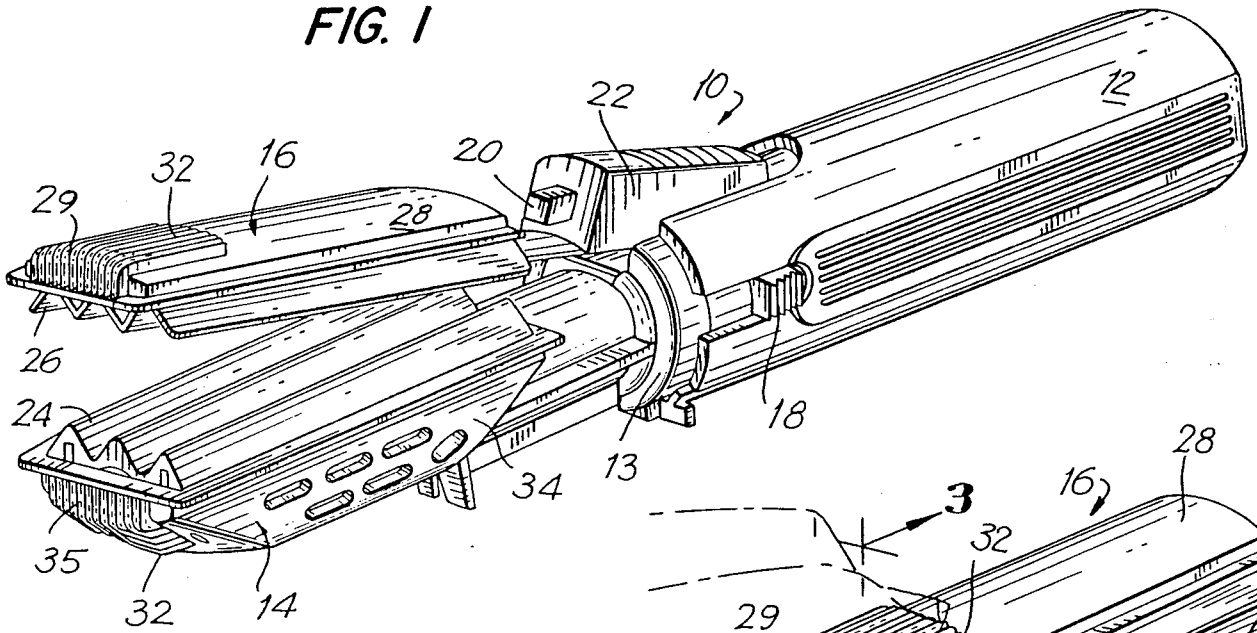
FIG. 1 is a perspective view of the hairstyling device showing the hairstyling jaw members in their open position.

A heated appliance 10, preferably, a hair curler or crimper is shown heated by a self-contained, fuel containing cartridge located in handle 12. This preferred embodiment of the heated appliance is powered by the self-contained cartridge and, therefore, the requirements for an electrical cord, plug and access to an electrical receptacle are eliminated. Of course, the present invention could be adapted to be used with an electrically heated hairstyling appliance but the preferred embodiment of the invention is fully portable and generates heat by the burning of the fuel contained in the cartridge. The cartridge is housed within the generally cylindrical handle 12. The cartridge when the fuel is exhausted is replaceable. A generally cylindrical cartridge-piercing and holding member 13 interacts with the cartridge and the handle snaps over the cartridge and then into place. When it is desired to replace the cartridge, the handle 12 is removed from the holding member 13 to expose the cartridge. The spent cartridge is then removed and discarded and a new cartridge inserted into the holding member 13. Then, the handle 12 is slid over the cartridge and snapped onto the holding member by any conventional cooperation of tabs and holding members which hold the handle in place until it is desirably intended to be removed once again for cartridge replacement.

Extending forwardly from the cartridge holding member 13 is a stationary hairstyling jaw member 14. The fuel burner (not shown), which provides the heat for the heated appliance 10, projects into the interior of stationary jaw member 14 and is located below a convoluted aluminum plate 24. Plate 24 is secured to the stationary hairstyling jaw member 14. The mechanics of the fuel burner and fuel cartridge system do not form part of the present invention and the teachings of U.S. Pat. Nos. 4,733,651 (issued Mar. 29, 1988) and 4,699,123 (issued Oct. 13, 1987) are specifically incorporated by reference herein and can, if desired, form one embodiment of the internal heating mechanism for the present invention. In any event, it should be appreciated that the heated appliance 10 provides heat to convoluted aluminum plate 24, either by the burning of the fuel contained within the cartridge or, alternatively, by electricity.

According to the preferred embodiment of the present invention, the heated appliance 10 is butane powered by the aforementioned self-contained cartridge of fuel and, to this extent, a switch 18 having an ON and an OFF position, is provided for the opening of a fuel flowing valve serving to connect fuel from the cartridge to the fuel burner system. In addition, an ignitor button 20 is provided for providing the required spark to initiate burning of the fuel after the switch 18 is put into its ON position and the fuel is released from the cartridge through the valve to the fuel burner assembly. The heat generated by the fuel burner assembly is transmitted to the aluminum plate 24.

Pivotally secured to the cartridge holding member 13 is a movable hairstyling jaw member 16. It has a generally curved outside surface 28. A convoluted aluminum sheet 26 is held on the underside or interior of the movable jaw member. The convoluted aluminum sheet 26, in the preferred embodiment, conforms to the surface configuration of the convoluted aluminum plate 24 of stationary jaw member 14 such that when the stationary jaw member and the movable jaw member come together, a predetermined shape will be imparted to a lock, strand or tress of hair placed and held for a time between the aluminum sheet 26 and aluminum plate 24. Thus, the hair is styled according to the shape of the plate 24. This effect is, of course, further enhanced and provided so as to last for more time when the aluminum plate and sheet are heated by the fuel burner system. A thumb lever 22 is provided effectuate movement of the movable hairstyling jaw member 16 out of engagement with the stationary hairstyling jaw member 14 so that the lock or strand of hair can be easily inserted between the convoluted aluminum plate 24 and the convoluted aluminum sheet 26. Release of the thumb lever 22 causes the movable jaw member to clamp hair against the stationary jaw member, between aluminum plate 24 and sheet 26.

Figure 2:
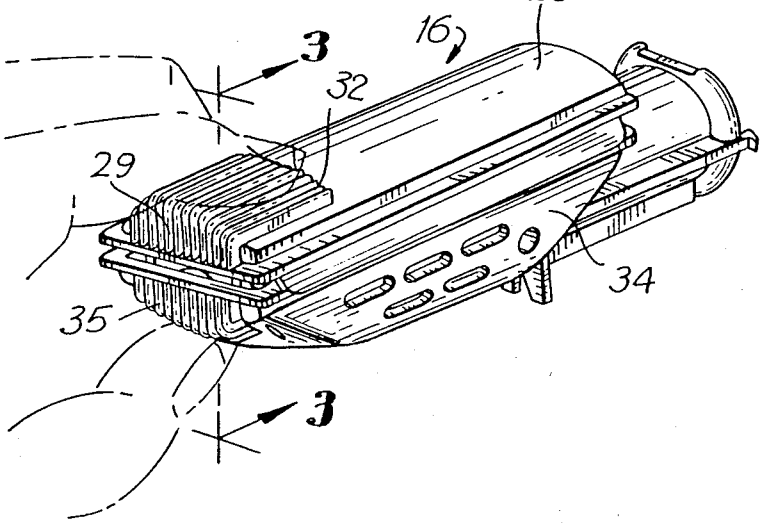
FIG. 2 is a perspective view of the hairstyling jaw members in their closed position with the fingers of a user's hand being shown in dotted outline, touching the raised ribs of the device.
Figure 3:
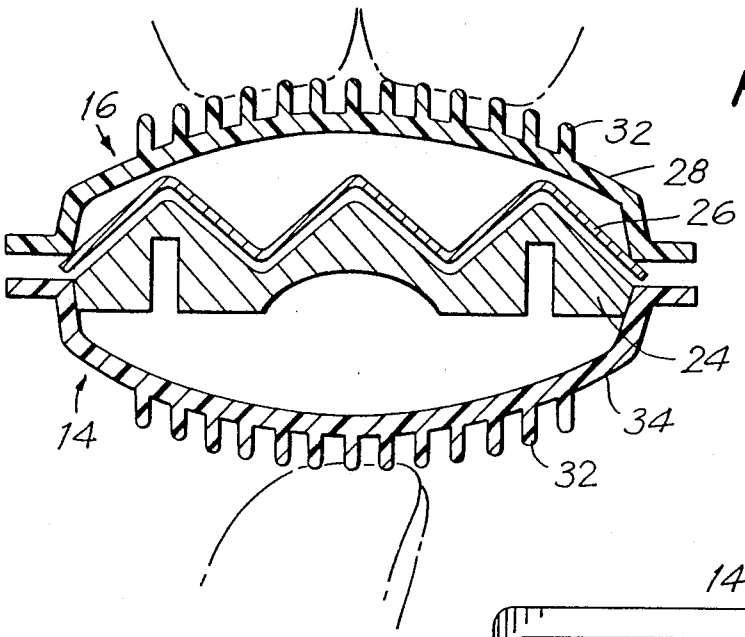
FIG. 3 is cross-sectional view taken along lines 3—3 of FIG. 2.
Figure 4:
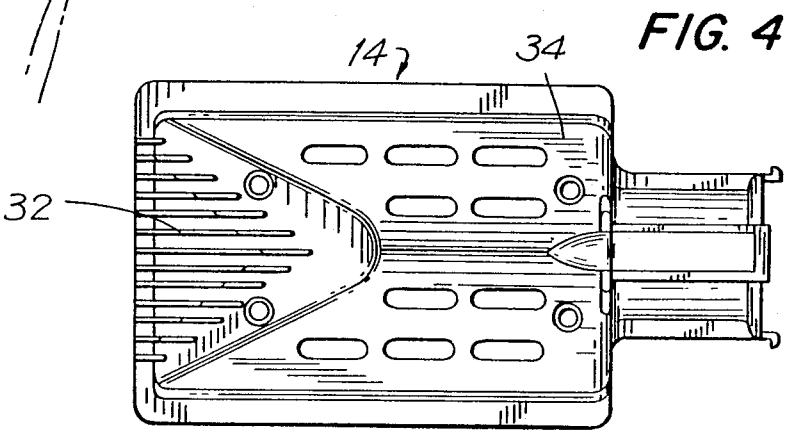
FIG. 4 is a bottom-plan view of the lower or stationary hairstyling jaw member.

As best seen in FIGS. 2 and 3, a series of upwardly extending raised, yet spaced, ribs 32 are provided to both the movable jaw member 16 and the stationary jaw member 14. Preferably, these raised ribs extend not just on the outside surfaces 28 and 34, of the movable hairstyling jaw member 16 and stationary hairstyling jaw member 14, respectively, but, in addition, wrap around to the front portions 29 and 35 of the jaw members. The spaced ribs 32 serve multiple functions. More specifically, the raised ribs provide a finger touch or contact surface for the user such that greater pressure can be provided between the jaw members to facilitate and enhance the hairstyling and crimping of the hair placed between the opposed jaw members. In addition, with other hairstyling devices as, for example, hair curlers, it is often necessary to wrap the hair about the curling device and this is often accomplished by gripping the end of the tress of hair and then rotating the curler to wrap the hair onto the heated outside surface of the curling rod. This is facilitated by use of a finger grip or contact surface which, according to the present invention is provided by the upwardly extending raised ribs located on opposed jaw members 14 and 16. In addition, the raised and spaced ribs 32 facilitate the radiation and dispersion of heat from the aluminum plate and sheet so that the device does not get too hot. Thus, the upwardly raised ribs simultaneously cool the heated appliance and allow the fingers of the user to actually contact and touch the jaw members for facilitating the hair styling procedure.

In operation, the stationary jaw member 14 is heated to its desired operating temperature. According to the preferred embodiment of the present invention, this is accomplished by release of the fuel from the fuel cartridge contained within the handle 12. In this embodiment, the cartridge is screwed into the cartridge holding member 13 and then, when it is desired to heat the stationary jaw member, switch 18 is switched from its OFF position to its ON position and this causes a plunger to pierce the valve of the cartridge to release fuel through the valve and to the burner mechanism. Then, the ignitor button 20 is depressed until a spark is created to ignite and cause the fuel to commence burning. The fuel burner, by being in close proximity to the convoluted aluminum plate 24, causes it to rapidly heat up. Of course, a temperature controlling mechanism is provided into the fuel burner assembly to control the temperature that the aluminum plate attains. Alternatively, the convoluted aluminum plate 24 can be heated by being electrically connected to ordinary household current. In either event, however, the convoluted aluminum plate 24 rapidly heats up to the desired operating temperature.

The convoluted aluminum sheet 26, overlaying convoluted aluminum plate 24 and being substantially in direct contact therewith, also heats up to its desired operating temperature. Then, after the plate and sheet are heated, the user merely depresses thumb lever 22 to open up the movable jaw member 16, i.e., move it away, by pivoting, from the convoluted aluminum plate 24. Then, the user places the tress or lock of hair between the convoluted aluminum plate 24 and aluminum sheet 26 and the thumb lever 22 is released so that the movable hairstyling jaw member 16 is, once again, directly on top of the stationary jaw member 14. This holds the hair between the plate and sheet, and the heat of the plate and sheet causes the lock of hair to be styled as desired. According to the embodiment of the invention shown in the drawings, the hair is crimped.

To facilitate the manual manipulation of the hair with respect to the crimping plates and, within the embodiment of the invention wherein a hair curler is used, the user can contact the finger contact portions or raised ribs 32. These not only allow the user to hold the ends of the jaw members and press them together to facilitate and enhance the hairstyling effect, but, in addition, allow easy rotation of the device about its longitudinal axis, where desired, while simultaneous allowing the aluminum plates and the heat generated thereby to radiate outwardly so that the outside surface of the stationary jaw member and removable jaw member is cooled and the temperature of the convoluted plate and sheet is controlled.

Basically, the raised ribs, which are spaced apart, provide a greater surface area for the radiation of heat and this not only cools the stationary hairstyling jaw member 14 and the movable hairstyling jaw member 16, but, in addition, allows the user to contact the jaw members with her fingers which is often required in hairstyling procedures, especially when the user is doing the hairstyling on her own hair.

It should be appreciated that the present specific form of the invention, herein illustrated and described, is intended to be representative only, as certain changes may be made therein without departing from the clear teachings of the disclosure and invention. Accordingly, reference should be made to the following appended claims in determining the full scope of the invention.

What is claimed:

1. A heatable hairstyling device comprising:

a. a hand-grippable body section having a proximal end and a distal end;

b. a stationary haristyling jaw member secured to said distal end of said body section and having an interiorly directed heatable plate surface and a first exteriorly directed cooling surface;

c. A movable hairstyling jaw member pivotally secured to said distal end of said body section having an interiorly directed sheet which cooperates with said heatable plate surface to grip a tress of hair therebetween, and a second exteriorly directed cooling surface;

d. heating means for raising the temperature of said heatable plate surface to a temperature such that a hair tress held between said heatable plate surface and said sheet will conform to the predetermined shape defined by said heatable plate surface; and e. said first and second exteriorly directed cooling surfaces of said stationary and said movable hairstyling jaw members, respectively, having raised rib, finger contacting and heat radiating portions which provide surface areas for safe, finger holding of said jaw members at the other end of said jaw members from said distal end of said body section, and for dispersion of heat from said heatable plate surface to surroundings.

2. A heatable hairstyling device as claimed in claim 1, wherein said heat radiating means comprises a plurality of raised ribs.

3. A heatable hairstyling device as claimed in claim 1, wherein said exteriorly directed cooling surfaces of said stationary and movable jaw members have top and front face surfaces and said heat radiating portions extend from said top face surface to said front face of both of said stationary and movable jaw members.

4. A hairstyling device as claimed in claim 1, wherein said heatable plate and sheet comprise opposed convoluted surfaces for hair crimping.

* * * * *